US009102193B1

(12) United States Patent
Mahowald

(10) Patent No.: US 9,102,193 B1
(45) Date of Patent: Aug. 11, 2015

(54) BRUSH BUCKET BUDDY

(71) Applicant: Robert J. Mahowald, Cold Spring, MN (US)

(72) Inventor: Robert J. Mahowald, Cold Spring, MN (US)

(73) Assignees: Robert J. Mahowald, Cold Spring, MN (US); WOODEN SUNSET, INC., Cold Spring, MN (US)

( * ) Notice: Subject to any disclaimer, the term of this patent is extended or adjusted under 35 U.S.C. 154(b) by 50 days.

(21) Appl. No.: 13/756,512

(22) Filed: Jan. 31, 2013

Related U.S. Application Data

(60) Provisional application No. 61/594,368, filed on Feb. 2, 2012.

(51) Int. Cl.
*B65D 25/00* (2006.01)
*B44D 3/12* (2006.01)

(52) U.S. Cl.
CPC *B44D 3/12* (2013.01); *B44D 3/123* (2013.01); *B44D 3/127* (2013.01); *B44D 3/128* (2013.01)

(58) Field of Classification Search
CPC ..... B44D 3/12; B44D 3/123; B44D 3/121; B44D 3/127; B44D 1/128
USPC ..... 248/213.2, 110, 111, 113; 220/695, 220/696, 697, 698, 699, 700, 701, 702, 735, 220/736; 206/362, 361, 209; 222/465.1, 222/111; 211/65, 66
See application file for complete search history.

(56) References Cited

U.S. PATENT DOCUMENTS 286,405 A 10/1883 Edwards
288,692 A 11/1883 Cowley et al.
816,793 A 4/1906 Harris
1,263,925 A 4/1918 Polk
1,463,809 A 8/1923 Fritz
1,471,712 A 10/1923 Sohnle
1,559,288 A 10/1925 Shealy et al.
1,760,722 A 5/1930 Sill
2,196,614 A 4/1940 Spitz
2,355,549 A 8/1944 Myers
2,466,850 A 4/1949 Hoffman et al.
2,533,355 A 12/1950 Comfort
2,566,650 A 9/1951 Anderson
2,856,622 A 10/1958 Jacobsen
2,896,894 A 7/1959 Welsh (Continued)

OTHER PUBLICATIONS

"Bercom's Handy Paint Pail"; Toolmonger, Blog Archive; retrieved Oct. 12, 2010, 22 pgs.

(Continued)

*Primary Examiner* — Todd M Epps

(57) ABSTRACT

A slightly tapered annular ring is frictionally retained securely inside a pail. The ring may either have a conically tapered (currently amended) concave outer side (original) or may alternatively have two separate regions of larger outside diameter separated vertically from each other by a smaller outside diameter region. Rods protrude radially toward the center of the annular ring, and are used operatively to hang paint brushes. A strainer is formed by perforations in the top surface of the ring to allow paint to be poured while separating any hardened or thickened paint or other large particles. A brush comb and various tool holders may additionally be formed in the ring. In a further embodiment, the rods extend at a slight upward angle to the top of the pail, and a cover for the pail interacts with the rods to secure brushes and other utensils onto the rods when the cover is in place.

15 Claims, 4 Drawing Sheets

(56) References Cited

U.S. PATENT DOCUMENTS

| | | | | | |
|---|---|---|---|---|---|
| 3,156,364 | A | | 11/1964 | Wolcott | |
| 3,170,182 | A | | 2/1965 | Burian | |
| D212,384 | S | | 10/1968 | Darge | |
| 3,688,943 | A | * | 9/1972 | Brown | 220/697 |
| D233,818 | S | | 12/1974 | Hukuba | |
| 3,894,650 | A | | 7/1975 | Crump | |
| 4,094,431 | A | | 6/1978 | Wheeler | |
| 4,116,332 | A | | 9/1978 | Hartley | |
| 4,225,064 | A | * | 9/1980 | Westcott | 222/569 |
| 4,852,833 | A | | 8/1989 | Lockwood | |
| 4,893,723 | A | | 1/1990 | Seabolt | |
| 4,911,295 | A | * | 3/1990 | Venegoni | 206/372 |
| 5,016,773 | A | * | 5/1991 | Lockwood | 220/697 |
| 5,035,386 | A | | 7/1991 | Tucker | |
| 5,046,623 | A | | 9/1991 | Takacs | |
| 5,059,319 | A | | 10/1991 | Welsh | |
| 5,078,872 | A | | 1/1992 | Durant et al. | |
| 5,097,967 | A | | 3/1992 | Sica | |
| 5,244,090 | A | | 9/1993 | Keith | |
| 5,261,561 | A | * | 11/1993 | Hodges, Jr. | 220/735 |
| 5,350,065 | A | | 9/1994 | Darrey | |
| 5,577,632 | A | * | 11/1996 | Blanchette et al. | 220/792 |
| D386,372 | S | | 11/1997 | Weiss | |
| 5,683,009 | A | | 11/1997 | King | |
| 5,755,057 | A | * | 5/1998 | Dancer | 43/54.1 |
| 5,996,952 | A | | 12/1999 | Heywood | |
| 6,041,919 | A | | 3/2000 | Adams | |
| D435,154 | S | | 12/2000 | Garon | |
| 6,419,194 | B1 | | 7/2002 | LoSacco et al. | |
| 6,616,110 | B1 | | 9/2003 | McIntee | |
| 6,820,848 | B1 | * | 11/2004 | Adam | 248/213.2 |
| 7,090,972 | B1 | * | 8/2006 | Hogan et al. | 435/6.12 |
| 8,528,776 | B2 | * | 9/2013 | Treacy | 220/697 |
| 2010/0230413 | A1 | * | 9/2010 | Crudgington, Jr. | 220/495.02 |

OTHER PUBLICATIONS

"bookofjoe: Magnetic Paintbrush Holder"; retrieved Oct. 12, 2010, 3 pgs.

"Paint Brush Holder—Secures brush to bucket or can"; eBay item 150504263324; retrieved Oct. 12, 2010, 3 pgs.

* cited by examiner

BRUSH BUCKET BUDDY

CROSS REFERENCE TO RELATED APPLICATIONS

The present application claims the benefit under 35 USC 119(e) of U.S. provisional patent application Ser. No. 61/594,368 filed Feb. 2, 2012 and co-pending herewith, of like title and inventor ship, the teachings and contents which are incorporated herein by reference in entirety.

BACKGROUND OF THE INVENTION

1. Field of the Invention

The present invention pertains generally to receptacles, and more particularly to container attachments or adjuncts that include a scraper edge for removing excess material, and with a tool and brush holder.

2. Description of the Related Art

Even before recorded history, mankind has painted for pleasure, recorded communication, for preservation of objects, and undoubtedly for many other reasons. Through time, the process of making paints have been highly refined. The various ingredients used to formulate the paint are often chosen to achieve a desired set of characteristics. For example, for many decades, exterior paints that were intended to protect and preserve a surface were formulated using one or more of the various drying oils, such as linseed oil. These drying oils, once applied to a surface and left exposed to air, "dry" or react with the air to form a durable and non-porous film upon the surface.

Much more recently, paints have also been manufactured using various polymers such as acrylic and vinyl resins and even more complex co-polymers that molecularly combine multiple polymers to gain characteristics and benefits of each. Polymer-based paints may include drying oils, but nearly all modern polymer paints instead use a variety of special solvents, surfactants, and water to form an emulsion or colloidal solution in water. This has the benefit of more rapid drying, without the release of Volatile Organic Compounds (VOCs).

At first, these polymer paints were used almost exclusively on interior surfaces, since early polymer paints had poor resistance to ultraviolet (UV) radiation, moisture, and other agents such as molds that are found in the outdoor environment. However, with advances in the sciences of polymers and paint additives such as the development of effective UV inhibitors and mold inhibitors, modern polymeric paints can perform as well as, and in some cases better than traditional oil-based paints. Unfortunately, these polymer-based paints do not adhere well to surfaces previously coated with oil-based paints, and many surfaces still remain that have been painted with oil-based paints. This means that many painters must maintain supplies for both water-based polymer paints and also for oil-based paints.

As already aforementioned, throughout the ages painting has been both recreational and to help preserve surfaces such as dwellings, machinery, and other valuable apparatus. A seemingly infinite number of colors have been developed, allowing a painter the opportunity in many cases to improve ornamental appearance of objects and surfaces through color selection and, where permitted and desired, artistic selection and application of these diverse colors. Most desirably, even when the utilitarian purpose of preservation is the objective, painting will also incorporate more enjoyable activity and less chore. In most cases, this means the actual painting and the pleasure of the finished product can be enjoyable. However, preparation and clean-up from the painting are almost always considered to be chore.

What is desired by most painters is a way to reduce the effort of preparation and clean-up. Recognizing this need, a number of artisans have heretofore combined paint brushes with buckets. One objective of this combination is to allow the painter to place the brush in the bucket until the painter requires the brush again. This means the brush does not need to be set upon a surface and later cleaned up after. Others have created racks that may be inserted into a bucket, permitting the brushes to be suspended within the bucket. The bucket may initially contain paint, or may contain a suitable solvent or cleaner for the particular type of paint being used. If the bucket initially contains paint, then the painter has the option of either removing the brushes from the paint and cleaning them when finished, leaving the brushes in the paint and in this case typically covering the bucket, or the paint may be returned to a paint can and the bucket refilled with a suitable solvent for cleaning the brush. Finally, when brushes have been cleaned, the bucket may be emptied and the brushes left suspended to dry. This can be very important, since many very efficient, effective, and also typically expensive brushes have bristles that can be easily deformed or otherwise damaged through contact with other objects, particularly when the bristles are wet.

While some prior artisans have proposed various small enclosures or wraps for single brushes, such as for exemplary purposes U.S. Pat. No. 5,244,090 by Keith, entitled "Protective sheath and comb assembly for paint brush", the teachings and contents which are incorporated herein by reference, these wraps have a disadvantage in that the brush will tend to stay wet for an extended period, meaning that it may also mold or mildew, or otherwise undesirably support the growth of micro-organisms. Furthermore, wraps of the prior art may present additional cleaning challenges if the wrap is used with a paint-laden brush.

Exemplary patents that illustrate the combination of brush and receptacle, the contents and teachings of each which are incorporated herein by reference, include: U.S. Pat. No. 5,016,773 by Lockwood, entitled "Paint brush holder"; U.S. Pat. No. 5,046,623 by Takacs, entitled "Brush rack"; U.S. Pat. No. 286,405 by Edwards, entitled "Paint brush holder"; U.S. Pat. No. 288,692 by Cowley et al, entitled "Paint brush holder"; U.S. Pat. No. 816,793 by Harris, entitled "Brush holder"; U.S. Pat. No. 1,263,925 by Polk, entitled "Brush holder"; U.S. Pat. No. 1,471,712 by Sohnle, entitled "Case for holding brushes"; U.S. Pat. No. 1,559,288 by Shealy et al, entitled "Holder"; U.S. Pat. No. 1,760,722 by Sill, entitled "Attachment for paint buckets"; U.S. Pat. No. 2,196,614 by Spit; entitled "Paint bucket attachment"; U.S. Pat. No. 2,466,850 by Hoffman et al, entitled "Combined paintbrush holder and wiper"; U.S. Pat. No. 2,533,355 by Comfort, entitled "Paintbrush holder and cover therefor"; U.S. Pat. No. 2,566,650 by Anderson, entitled "Brush holder"; U.S. Pat. No. 2,896,894 by Welsh, entitled "Paint bucket and brush supporting bracket"; U.S. Pat. No. 3,156,364 by Wolcott, entitled "Paint brush holder"; U.S. Pat. No. 4,116,332 by Hartley, entitled "Combination brush holder and can connector"; U.S. Pat. No. 4,852,833 by Lockwood, entitled "Paint brush holder"; U.S. Pat. No. 5,035,386 by Tucker, entitled "Paintbrush holder"; U.S. Pat. No. 5,097,967 by Sica, entitled "Paint brush cleaning, drying, and storage container"; U.S. Pat. No. 5,683,009 by King, entitled "Accessories to enhance the recyclability of metal cans"; U.S. Pat. No. 5,996,952 by Heywood, entitled "Paint brush holder"; U.S. Pat. No. 6,041,919 by Adams, entitled "Lid and lid system for storing an implement in a container"; U.S. Pat. No. 6,419,194 by LoSacco et al, entitled "Paint brush holder"; and U.S. Pat. No. 6,616,110 by McIntee, entitled "Paint can attachment with brush holding slot".

Several additional tools have proven to be quite helpful to painters. Brush combs are illustrated in the following exemplary US patents, the teachings and contents which are incorporated herein by reference: U.S. Pat. No. 1,463,809 by Fritz, entitled "Metallic brush cleaner"; U.S. Pat. No. 2,856,622 by Jacobsen, entitled "Paint brush cleaning tool"; U.S. Pat. No. 3,170,182 by Burian, entitled "Paint brush cleaning tool"; Des U.S. Pat. No. 212,384 by Darge, entitled "Paint brush comb"; Des U.S. Pat. No. 233,818 by Hukuba, entitled "Brush cleaner"; Des U.S. Pat. No. 386,372 by Weiss, entitled "Tool"; and Des U.S. Pat. No. 435,154 by Garon, entitled "Combined brush comb and roller cleaner".

Brush wipers have also proven to be quite helpful. The following exemplary US patents illustrate brush wipers, the teachings and contents which are incorporated herein by reference: U.S. Pat. No. 2,355,549 by Myers, entitled "Brush wiper construction"; U.S. Pat. No. 4,225,064 by Westcott, entitled "Painter's accessory"; and U.S. Pat. No. 4,893,723 by Seabolt, entitled "Paint can attachment".

Strainers that separate liquid from solids have also proven to be quite helpful. The following exemplary US patents illustrate strainers, the teachings and contents which are incorporated herein by reference: U.S. Pat. No. 5,059,319 by Welsh, entitled "Paint can strainer cover"; and U.S. Pat. No. 5,078,872 by Durant et al, entitled "Combined strainer and pour spout apparatus".

With any painting project, there will be additional tools and apparatus that are desired to be kept readily available. U.S. Pat. No. 5,350,065 by Darrey, entitled "Tool and hardware carrier for bucket", the teachings and contents which are incorporated herein by reference, illustrates a bucket insert that accommodates many such tools. Finally, U.S. Pat. No. 3,894,650 by Crump, entitled "Attachment for grooved-rimmed containers"; and U.S. Pat. No. 4,094,431 by Wheeler, entitled "Paint tray with brush holding attachment" illustrate additional painting attachments, the teachings and contents of each which are also incorporated herein by reference.

In addition to the aforementioned patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is, in combination, a brush bucket buddy and a liquid-containing receptacle. The liquid containing receptacle has an open-top vessel defined by a bottom and a concave side that is operative to contain a liquid therein, with the concave side tapering from a lesser diameter adjacent the bottom to a larger diameter more distal therefrom. A cover in a first position operatively engages with the open-top vessel concave side and thereby closes the open-top vessel. In a second position the cover is removed from the open-top vessel concave side and thereby opens the open-top vessel. The brush bucket buddy has a generally annular body defining an outer, generally vertical concave side and a top surface extending radially inward from the concave outer side. The outer generally vertical concave side slightly tapers from a largest diameter adjacent the top surface to a lesser diameter more distal therefrom. At least one brush hanging pin is supported from and radiates towards a center of the generally annular body. The outer generally vertical concave side is engaged with the open-top vessel concave side to secure the annular body at a fixed height within the open-top vessel. The at least one brush hanging pin terminates adjacent the cover when the cover is in the first position and is spaced from the cover by a spacing operatively less than required for a brush suspended from the at least one brush hanging pin to release from the at least one brush hanging pin.

In a second manifestation, the invention is, in combination, a bucket adjunct and liquid-containing receptacle. The liquid containing receptacle has an open-top vessel defined by a bottom and a concave side and is operative to contain a liquid between vessel bottom and an open top. The concave side tapers from a lesser diameter adjacent the bottom to a larger diameter more distal therefrom. The bucket adjunct has a generally annular, body defining an outer generally vertical concave side and a top surface extending radially inward from the concave outer side. The outer generally vertical concave side slightly tapers from a first diameter adjacent the top surface to a second lesser diameter most distal therefrom, and has a third diameter less than the second lesser diameter intermediate between the first diameter and second lesser diameter. At least one brush hanging pin is supported from and radiates towards a center of the generally annular body. The generally annular body operatively engages with an interior of liquid-containing receptacle at the first diameter and the second lesser diameter and is operatively disengaged at the third diameter.

In a third manifestation, the invention is a brush bucket buddy. A generally annular body defines an outer generally vertical concave side. A top surface extends radially inward from the concave outer side. The outer generally vertical concave side slightly tapers from a largest diameter adjacent the top surface to a lesser diameter more distal therefrom. At least one brush hanging pin is supported from and radiates towards a center of the generally annular body. A small lip terminates the top surface adjacent an interior diameter thereof and extends downward therefrom and operatively provides both a combination of, material reinforcement for strength and a convenient brush wiping edge. A strainer perforating the top surface operatively allows liquid to be poured through while separating solid matter larger than a threshold size. A brush comb is formed in the top surface and is accessible adjacent an interior diameter of the top surface, to operatively comb a paintbrush drawn from the interior diameter through the comb and thereby operatively facilitate brush cleaning and maintenance. At least one ancillary tool holder is formed within the top surface to operatively support an ancillary tool.

OBJECTS OF THE INVENTION

Exemplary embodiments of the present invention solve inadequacies of the prior art by providing a slightly tapered annular ring that fits inside a chosen bucket such as a 5 gallon pail, or other pails, buckets or receptacles as appropriate. The ring is retained therein via friction with the pail concave side. The ring includes or may be fit with rods that protrude radially toward the center of the annular ring, from which brushes may be suspended. The ring also has a strainer built therein to allow paint to be poured therefrom while separating any hardened or thickened paint, such as the skim layer that commonly develops. Finally, a brush comb may additionally be formed in the ring. In a further embodiment, the rods extend at a slight upward angle to the top of the pail, and a cover for the pail interacts with the rods to secure brushes and other utensils onto the rods when the cover is in place.

A first object of the invention is to provide a functional pail attachment that may facilitate preparation for painting, the act of painting, and cleaning subsequent to painting. A second object of the invention is to provide such an attachment that, without modification, will engage with many diverse pails effectively. Another object of the present invention is to ensure a secure fit between the attachment and the pail that ensures proper orientation there between. A further object of the invention is to enable brushes and other utensils to be secured by the covering of the pail. Yet another object of the present invention is to provide a combination of brush comb, brush scraper, strainer, tool support and brush hanging apparatus all within a single apparatus. An additional object is to enable custom labeling with relatively simple and inexpensive mold inserts. Another object of the invention is to provide brush storage that helps to keep the bristles straight. A further object of the invention is to stack for shipment in a relatively compact manner. While most preferably an embodiment designed in accord with the teachings of the present invention will incorporate each of these objects, the invention is not limited solely thereto and may incorporate selected ones of the aforementioned objects in any appropriate combination without incorporating all objects.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
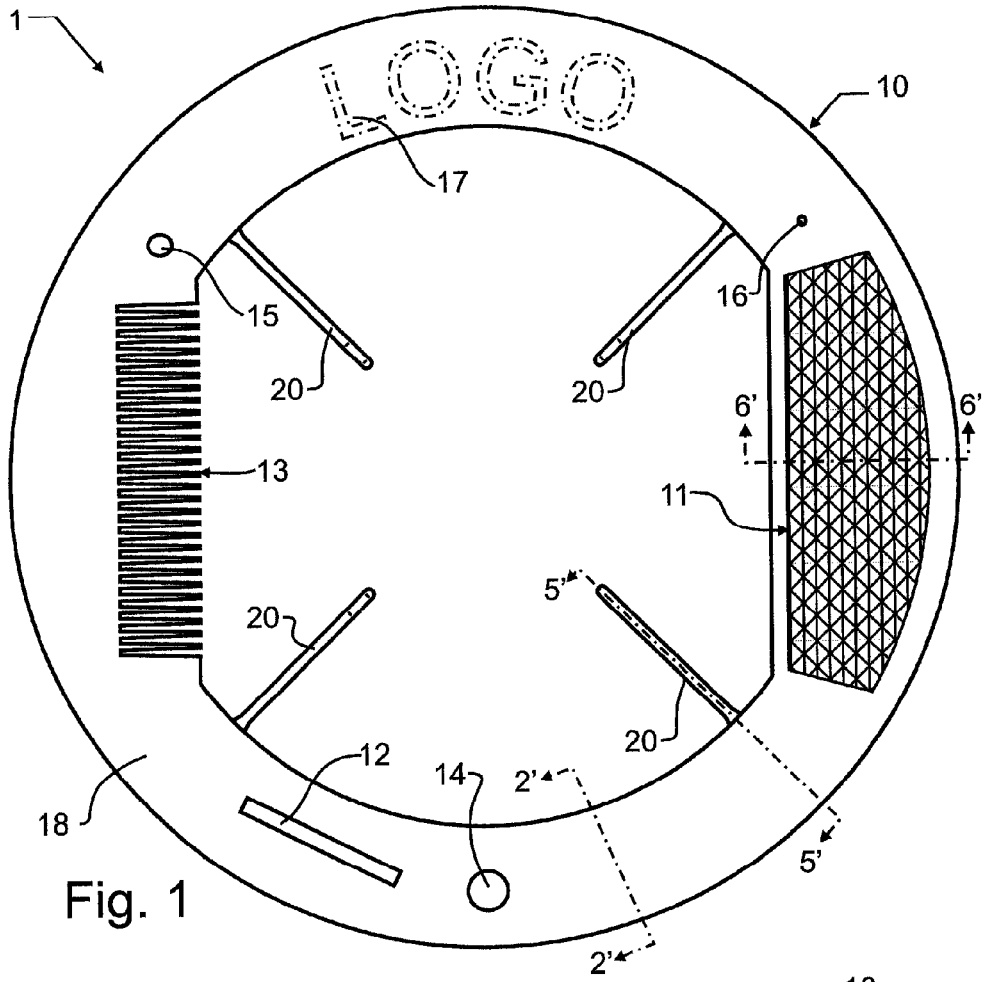
FIG. 1 illustrates a preferred embodiment brush bucket buddy designed in accord with the teachings of the present invention from a top plan view.
Figure 2:
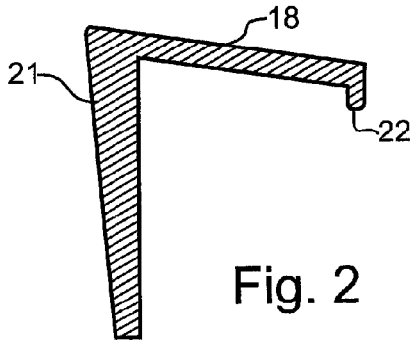
FIG. 2 illustrates a first embodiment cross-section of the annular body from sectional view taken along section line 2' of FIG. 1.

In a preferred embodiment of the invention illustrated in the Figures, a brush bucket buddy 1 is comprised of a generally annular body 10 having one or more generally cylindrical brush hanging pins 20 radiating towards the center of the generally annular body. In the preferred embodiment of FIG. 1, these brush hanging pins 20 are illustrated as being generally cylindrical rods and thereby define a longitudinal axis within each rod, which is the preferred embodiment. Alternatively, other geometries may be used for these brush hanging pins 20, including such geometries as S-hooks, various curves, and any other suitable geometry.

As best illustrated in FIGS. 2,3, and 5-7, annular body 10 is slightly tapered to nest inside a 5 gallon bucket, or other pails, buckets or receptacles, most of which have concave side such as pail side 53 that are also slightly tapered from a largest diameter adjacent the open top to a lesser diameter adjacent the closed pail bottom. This slight taper in both pail concave side 53 and concave outer side 21 of annular body 10 ensures that annular body 10 is retained within pail 50 via friction with pail concave side 53. Furthermore, pails of similar but not identical diameters will still be readily accommodated, since annular body 10 will engage with pail concave side 53 wherever the diameter matches annular body 10. In other words, annular body 10 will engage with a slightly larger diameter pail more nearly to the pail bottom, and will engage with a slightly smaller diameter pail more nearly to the pail open top.

A top surface 18 extends radially inward from outer concave side 21, preferably with a slight downward slope towards the center of annular body 10. Top surface 18 also preferably terminates in a small lip 22 that provides both a combination of material reinforcement for strength and a convenient brush wiping edge.

Figure 3:
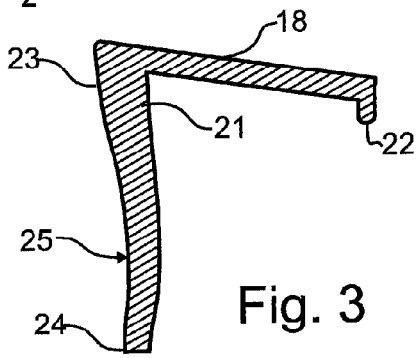
FIG. 3 illustrates a second embodiment cross-section of the annular body from sectional view taken along section line 2' of FIG. 1.

FIG. 3 illustrates an alternative embodiment cross-section for annular body 10 that includes a gentle inward curve 25 of lesser outside diameter than either upper concave outer seal ring 23 or lower concave outer seal ring 24. This loads additional force upon upper outer concave seal ring 23 or lower concave outer seal ring 24, which can provide significantly better securement and sealing with a pail, in at least some cases. Furthermore, if a pail concave side such as pail concave side 53 is not smooth and consistently tapered, upper concave side seal ring 23 and lower outer concave side seal ring 24 will both more likely seat, reducing the chance for annular body 10 to rest against a single bump about which annular body 10 might undesirably swivel or rotate.

Annular body 10 includes or may be fit with one or more brush hanging pins 20 that protrude radially toward the center of the annular ring, from which paint brushes 60 and other suitable tools may be suspended. The quantities, length and geometry of brush hanging pins 20 will determine how many painting implements may be suspended. Further, these brush hanging pins 20 may be formed integrally or unitarily with annular body 10, or may be inserted into and removable from appropriate features in annular body 10. Where the brush banging pins 20 are designed to be inserted into and removable from appropriate features in annular body 10, an additional channel may be provided circumscribing annular body 10 and having a large assortment of holes that likewise may partially or fully circumscribe annular body 10, so that a user may select both quantity and spacing of brush hanging pins 20.

Figure 7:
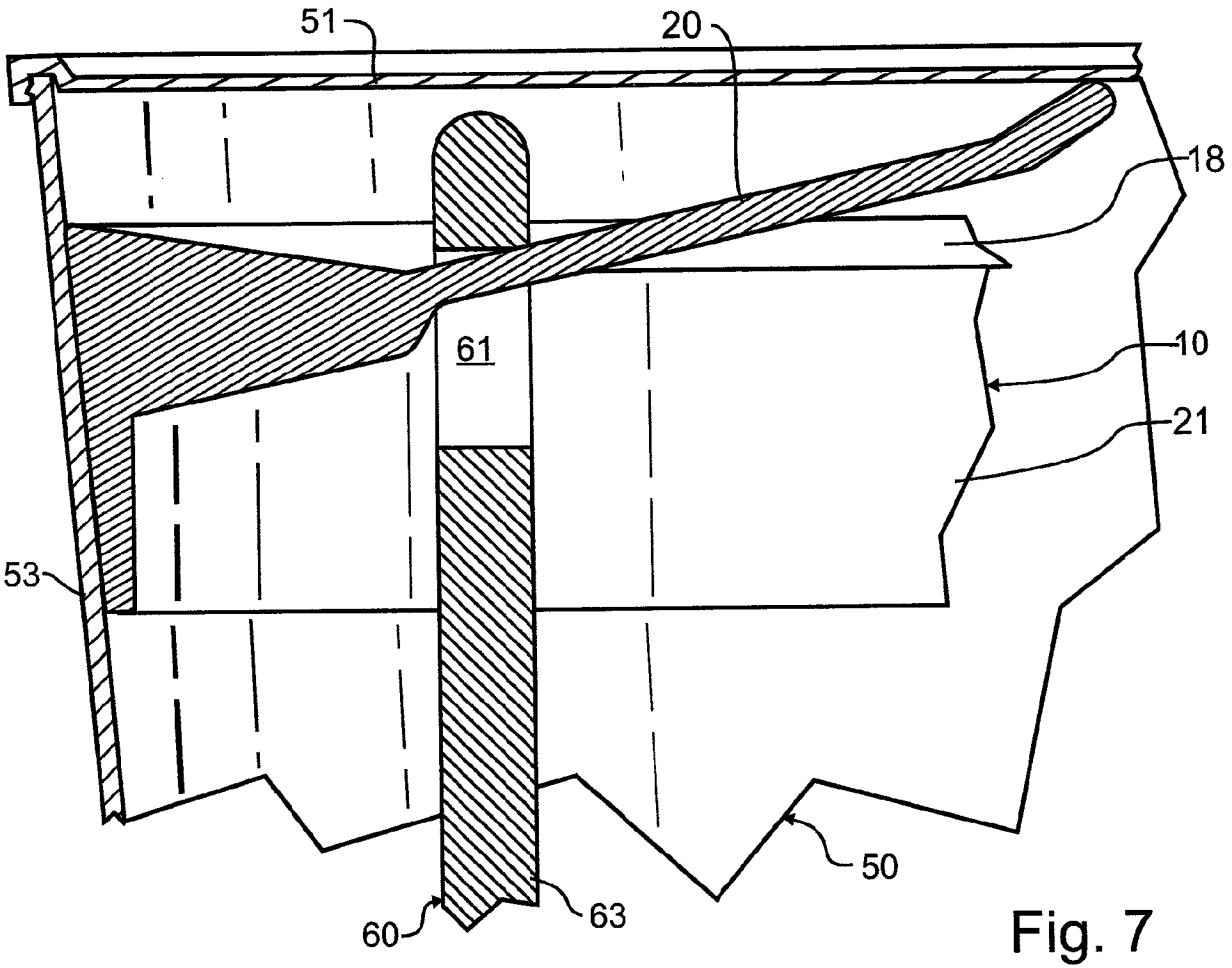
FIG. 7 illustrates the preferred embodiment brush bucket buddy of FIG. 1 in further combination with a plastic pail and a paint brush from a partial sectional view, taken along section line 5' of FIG. 1.

Optionally, either brush hanging pins 20 are slightly resilient or the supports within annular body 10 for brush hanging pins 20 are slightly resilient. As FIG. 7 illustrates, when annular body 10 is engaged with a pail 50 at pail side wall 53 and a cover 51 is placed over and engaged or secured with pail concave side 53, then cover 51 may also engage with or preferably press down slightly on brush hanging pins 20. While brush hanging pins 20 may be rigid, a slight resilience will facilitate a secure engagement between brush hanging pins 20 and cover 51. In another embodiment, cover 51 may have additional features or may provide suitable resilience, if so desired. In yet another embodiment, brush hanging pins 20 may terminate adjacent to but not in contact with cover 51 when cover 51 is engaged with and closing pail 50 at pail side wall 53. As long as brush hanging pins 20 terminate adjacent to cover 51 and are separated therefrom by a spacing operatively less than required for a brush 60 suspended from brush hanging pins 20 to release therefrom, then, even without direct contact between brush hanging pins 20 and cover 51, a brush 60 will still remain secured to brush hanging pins 20 when cover 51 is in place.

In this preferred embodiment brush bucket buddy 1, annular body 10 also has a strainer 11 built therein, such as by providing a plurality of perforations through top surface 18, to allow paint, solvent or other liquid to be poured therefrom while separating any lumps or solid matter larger than a threshold size defined by the strainer openings. While not limiting the present invention solely thereto, and instead for exemplary purposes only, this solid matter might be hardened or thickened paint. As visible in FIG. 6, the region of top surface 18 defining strainer 11 might also be slightly depressed, helping to ensure that liquids temporarily held within the openings properly drain back into pail 50 rather than dispersing about top surface 18.

A holder 12 may also preferably be provided for a 5-in-one tool, a tool painters often use. Screwdrivers and the like may be stored in one or more holes such as 15, 16. A logo may be imprinted through letters 17, and this logo may incorporate custom or so-called private labeling for a variety of vendors or advertisements. A brush comb 13 may additionally be formed in annular body 10, so that a painter may draw the brush through the comb and facilitate brush cleaning and maintenance. A rounded edge 14 may also be formed, which for exemplary purposes may be used to scrape a round brush just prior to use.

As is visible in FIG. 7, a cover 51 may also be provided, permitting brush bucket buddy 1 and brushes 60 having ordinary hanging holes 61 formed in brush handles 63 to be suspended on brush hanging pins 20 inside of pail 50, and covet 51 still placed over the top to enclose pail 50. This is particularly desirable for transport to reduce the chance of splashes and spills, and also for storage where a volatile solvent such as mineral spirits fills the pail. Additionally, even when pail 50 is empty, it is still desirable to ensure that brushes 60 remain hanging, to better protect the brush bristles.

A painter may prefer to have more than one brush bucket buddy 1, for exemplary purposes using one for brushes used with latex-based paint and another for brushes used with oil-based paint. Brushes 60 hang freely therein, meaning brush bristles are not deformed and instead stay straight between uses. The brushes are ready for use simply by opening pail cover 51 and removing the brush 60 from brush hanging pins 20.

Figure 4:
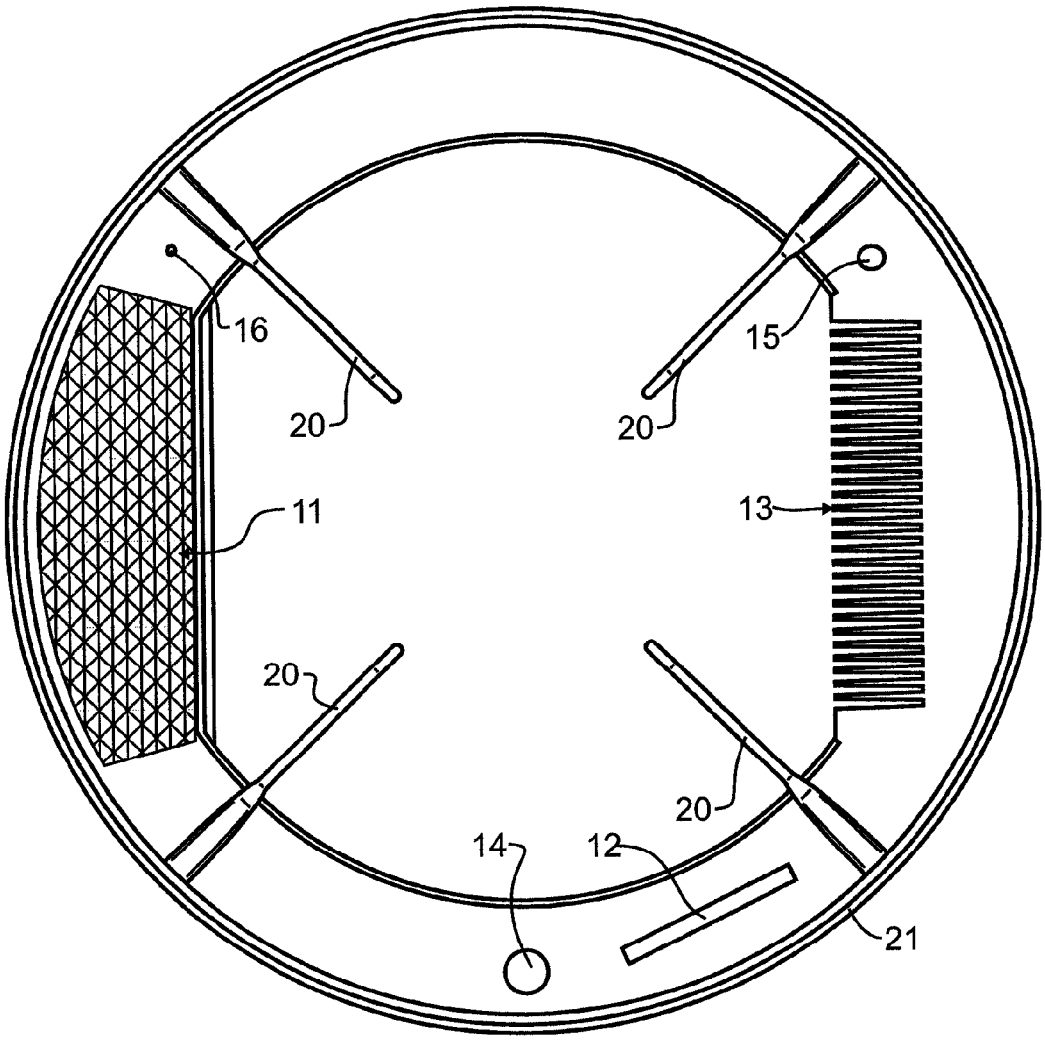
FIG. 4 illustrates the preferred embodiment brush bucket buddy of FIG. 1 from a bottom plan view.
Figure 5:
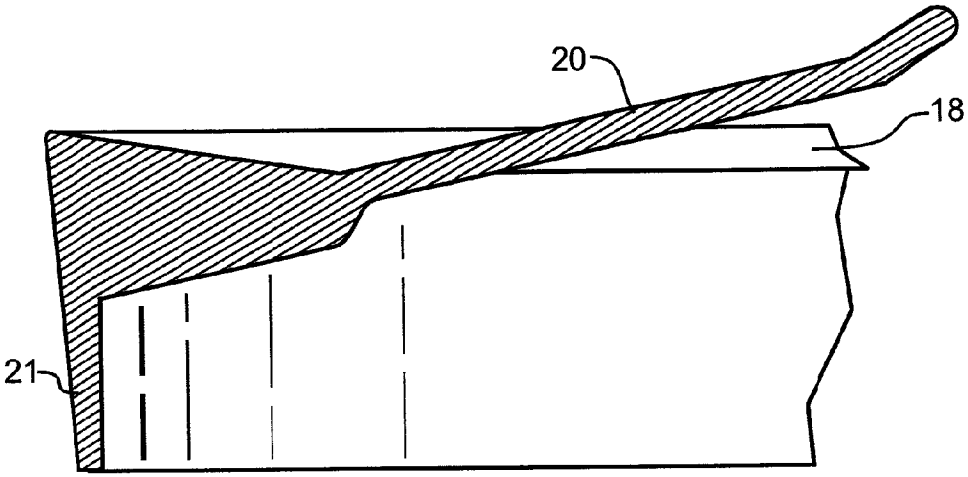
FIG. 5 illustrates the preferred embodiment brush bucket buddy of FIG. 1 from a partial sectional view, taken along section line 5' of FIG. 1.
Figure 6:
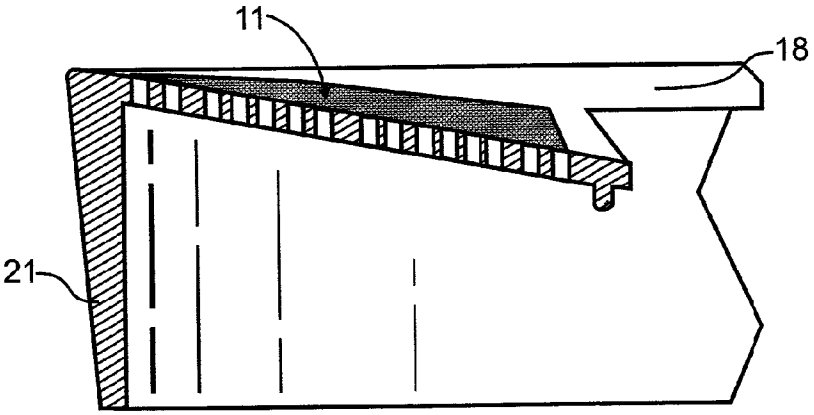
FIG. 6 illustrates the preferred embodiment brush bucket buddy of FIG. 1 from a partial sectional view, taken along section line 6' of FIG. 1.

From the foregoing figures and description, several additional features and options become more apparent. First of all, brush bucket buddy 1 may be manufactured from a variety of materials, including metals, resins and plastics, ceramics or cementitious materials, or even combinations or composites of the above. The specific material used may vary, though special benefits are attainable if several important factors are taken into consideration. First, brush bucket buddy 1 will preferably be resistant to various solvents and chemicals that might be used inside a pail. Furthermore, it is preferable that all materials are sufficiently tough and durable to not fracture, even when great forces are applied thereto. This is particularly important in the materials for brush hanging pins 20 and the material of annular body 10 that directly supports and engages with brush hanging pins 20. As may be apparent from the Figures, in particular FIGS. 4, 5 and 7, annular body 10 may further be formed with a thicker or heavier region adjacent to brush hanging pins 20. In the preferred and alternative embodiment annular bodies 10, a preferred material is recycled, solvent resistant plastic such as polyethylene, polypropylene, high density polyethylene, Ultra-High Molecular Weight (UHMW) polyethylene, and other similar materials which have the advantages of being solvent and stain resistant, extremely tough and durable to withstand great force, scuff resistant, and readily colored.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. In combination, a brush bucket buddy and a liquid-containing receptacle, said liquid containing receptacle comprising:

an open-top vessel defined by a bottom and a concave side and operative to contain a liquid therein, said concave side tapering from a lesser diameter adjacent said bottom to a larger diameter more distal therefrom;

a cover in a first position operatively engaged with said open-top vessel concave side and thereby closing said open-top vessel and in a second position removed from said open-top vessel concave side and thereby opening said open-top vessel; said brush bucket buddy comprising:

a generally annular body defining an outer generally vertical concave side and a top surface extending radially inward from said concave outer side, said outer generally vertical concave side slightly tapering from a largest diameter adjacent said top surface to a lesser diameter more distal therefrom; and at least one brush hanging pin supported from and radiating towards a center of, said generally annular body;

said outer generally vertical concave side engaged with said open-top vessel concave side to secure said annular body at a fixed height within said open-top vessel; and said at least one brush hanging pin terminating adjacent said cover when said cover is in said first position and spaced from said cover by a spacing operatively less than required for a brush suspended from said at least one brush banging pin to release from said at least one brush hanging pin.

2. The combination brush bucket buddy and liquid-containing receptacle of claim 1, wherein said at least one brush hanging pin is resilient, operatively contacts said cover when said cover is in said first position, and flexes responsive to said operatively contacting said cover.

3. The combination brush bucket buddy and liquid-containing receptacle of claim 1, wherein said outer generally vertical concave side slightly tapering from a first largest diameter adjacent said top surface to a second lesser diameter more distal therefrom.

4. The combination brush bucket buddy and liquid-containing receptacle of claim 3, wherein said outer generally vertical concave side further comprises a third diameter less than said second lesser diameter and located vertically along said outer generally vertical side intermediate between said first largest diameter and said second lesser diameter, said generally annular body operatively engaging with said open-top vessel concave side at said first largest diameter and said second lesser diameter and operatively disengaged at said third diameter.

5. The combination brush bucket buddy and liquid-containing receptacle of claim 1, wherein said generally annular body further comprises:

a small lip terminating said top surface adjacent an interior diameter thereof and extending downward therefrom that operatively provides both a combination of material reinforcement for strength and a convenient brush wiping edge;

a strainer perforating said top surface to operatively allow liquid to be poured through while separating solid matter larger than a threshold size;

a brush comb formed in said top surface and accessible adjacent an interior diameter thereof, to operatively comb a paintbrush drawn from said interior diameter through said comb and thereby operatively facilitate brush cleaning and maintenance; and at least one ancillary tool holder formed within said top surface to operatively support an ancillary tool.

6. In combination, a bucket adjunct and liquid-containing receptacle;

said liquid containing receptacle comprising:

an open-top vessel defined by a bottom and a concave side and operative to contain a liquid between said vessel bottom and an open top, said concave side tapering from a lesser diameter adjacent said bottom to a larger diameter more distal therefrom;

said bucket adjunct comprising:

a generally annular body defining an outer generally vertical concave side and a top surface extending radially inward from said concave outer side, said outer generally vertical concave side slightly tapering from a first diameter adjacent said top surface to a second lesser diameter most distal therefrom and having a third diameter less than said second lesser diameter intermediate between said first diameter and said second lesser diameter; and at least one brush hanging pin supported from and radiating towards a center of said generally annular body;

said generally annular body operatively engaging with an interior of said liquid-containing receptacle at said first diameter and said second lesser diameter and operatively disengaged at said third diameter.

7. The combination bucket adjunct and liquid-containing receptacle of claim 6, wherein said liquid-containing receptacle further comprises a cover in a first position operatively engaged with said open-top vessel concave side and thereby closing said open-top vessel and in a second position removed from said open-top vessel concave side and thereby opening said open-top vessel.

8. The combination bucket adjunct and liquid-containing receptacle of claim 7, wherein said at least one brush hanging pin terminates adjacent said cover when said cover is in said first position and is spaced from said cover by a spacing operatively less than required for a brush suspended from said at least one brush hanging pin to release from said at least one brush hanging pin.

9. The combination bucket adjunct and liquid-containing receptacle of claim 6, wherein said bucket adjunct further comprises:

a small lip terminating said top surface adjacent an interior diameter thereof and extending downward therefrom that operatively provides both a combination of material reinforcement for strength and a convenient brush wiping edge;

a strainer perforating said top surface to operatively allow a liquid to be poured through while separating solid matter larger than a threshold size;

a brush comb formed in said top surface and accessible adjacent an interior diameter thereof, to operatively comb a paintbrush drawn from said interior diameter through said comb and thereby operatively facilitate brush cleaning and maintenance; and at least one ancillary tool holder formed within said top surface to operatively support an ancillary tool.

10. The combination bucket adjunct and liquid-containing receptacle of claim 6, wherein said bucket adjunct further comprises a strainer perforating said top surface to operatively allow a liquid to be poured through while separating solid matter larger than a threshold size, said strainer slightly depressed below said top surface to operatively direct liquids temporarily held within said perforations to drain into said liquid-containing receptacle.

11. A brush bucket buddy, comprising:

a generally annular body defining an outer generally vertical concave side and a top surface extending radially inward from said outer concave side, said outer generally vertical concave side slightly tapering from a largest diameter adjacent said top surface to a lesser diameter more distal therefrom;

at least one brush hanging pin supported from and radiating towards a center of said generally annular body;

a small lip terminating said top surface adjacent an interior diameter thereof and extending downward therefrom that operatively provides both a combination of material reinforcement for strength and a convenient brush wiping edge;

a strainer perforating said top surface to operatively allow liquid to be poured through while separating solid matter larger than a threshold size;

a brush comb formed in said top surface and accessible adjacent an interior diameter thereof, to operatively comb a paintbrush drawn from said interior diameter through said comb and thereby operatively facilitate brush cleaning and maintenance; and at least one ancillary tool holder formed within said top surface to operatively support an ancillary tool.

12. The brush bucket buddy of claim 11, wherein said strainer is slightly depressed below said top surface.

13. The brush bucket buddy of claim 11, further comprising a liquid-containing receptacle having:

an open-top vessel defined by a bottom and a concave side and operative to contain a liquid therein, said concave side tapering from a lesser diameter adjacent said bottom to a larger diameter more distal therefrom; and a cover in a first position operatively engaged with said open-top vessel concave side and thereby closing said open-top vessel and in a second position removed from said open-top vessel concave side and thereby opening said open-top vessel;

said outer generally vertical concave side engaged with said open-top vessel concave side to secure said annular body at a fixed height within said open-top vessel; and said at least one brush hanging pin terminating adjacent said cover when said cover is in said first position and spaced from said cover by a spacing operatively less than required for a brush suspended from said at least one brush hanging pin to release from said at least one brush hanging pin.

14. The brush bucket buddy of claim 13, wherein said at least one brush hanging pin is resilient, operatively contacts said cover when said cover, is in said first position, and flexes responsive to said operatively contacting said cover.

15. The brush bucket buddy of claim 11, wherein said outer generally vertical concave side further comprises a third diameter less than said second lesser diameter and located vertically along said outer generally vertical concave side intermediate between said first largest diameter and said second lesser diameter, said generally annular body operatively engaging with said open-top vessel concave side at said first largest diameter and said second lesser diameter and operatively disengaged at said third diameter.

* * * * *